United States Patent [19]

Barlow et al.

[11] 4,040,621

[45] Aug. 9, 1977

[54] SIMULATED VOLLEYBALL GAME APPARATUS

[75] Inventors: Gordon A. Barlow, Evanston; Anson Isaacson, Chicago, both of Ill.

[73] Assignee: Marvin Glass & Associates, Chicago, Ill.

[21] Appl. No.: 653,933

[22] Filed: Jan. 30, 1976

[51] Int. Cl.[2] ..... A63F 7/06

[52] U.S. Cl. ..... 273/85 C; 273/95 A

[58] Field of Search ..... 273/85 R, 85 C, 85 E, 273/26 E, 29 A, 95 A, 98, 129 HB, 200 B

[56] References Cited

U.S. PATENT DOCUMENTS

| | | | |
|---|---|---|---|
| 2,199,461 | 5/1940 | Jones | 273/95 A |
| 2,633,320 | 3/1953 | Salmi | 273/26 E |
| 2,668,057 | 2/1954 | Fry | 273/129 HB |
| 3,074,720 | 1/1963 | Carver et al. | 273/85 E |
| 3,904,203 | 9/1975 | Matsumoto | 273/85 R |
| 3,936,050 | 2/1976 | Hornsby, Jr. | 273/95 A |

FOREIGN PATENT DOCUMENTS

| | | | |
|---|---|---|---|
| 957,117 | 8/1949 | France | 273/85 R |
| 1,035,760 | 4/1953 | France | 273/95 A |
| 591,721 | 1/1934 | Germany | 273/85 R |
| 410,864 | 5/1934 | United Kingdom | 273/200 B |
| 1,075,415 | 7/1967 | United Kingdom | 273/85 C |
| 1,155,495 | 6/1969 | United Kingdom | 273/85 R |

*Primary Examiner*—Anton O. Oechsle
*Assistant Examiner*—Harry G. Strappello
*Attorney, Agent, or Firm*—Mason, Kolehmainen, Rathburn & Wyss

[57] ABSTRACT

A simulated volley ball game apparatus including a central standard about which a ball is connected for universal movement by a tethering arm. A net is provided to define a pair of opposed playing areas and three ball impellers are disposed on each side of the net and spaced therefrom generally the length of the tethering arm. The ball impellers are manually actuatable so that the players may attempt to contact the ball as in the game of volley ball to pass it to another of his teammates or across the net to opposing ball impellers. The standard has a plurality of detents spaced radially about the top thereof in alignment with the six ball impellers to guide the tethering means and thus the ball in the direction of one of the impellers.

10 Claims, 7 Drawing Figures

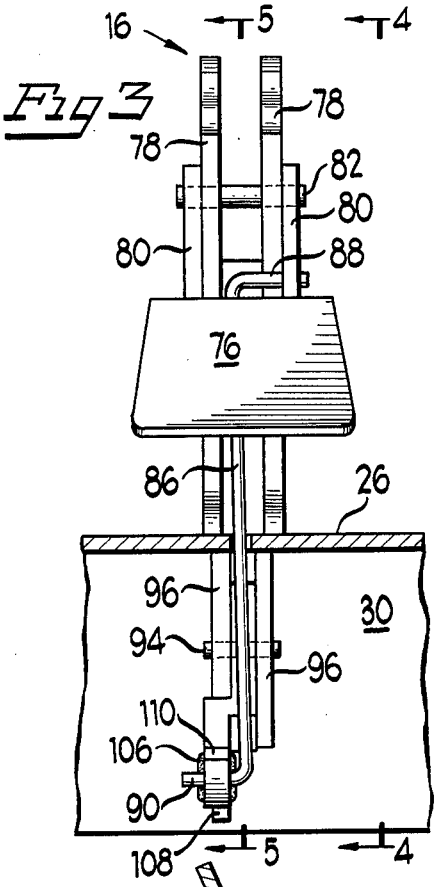
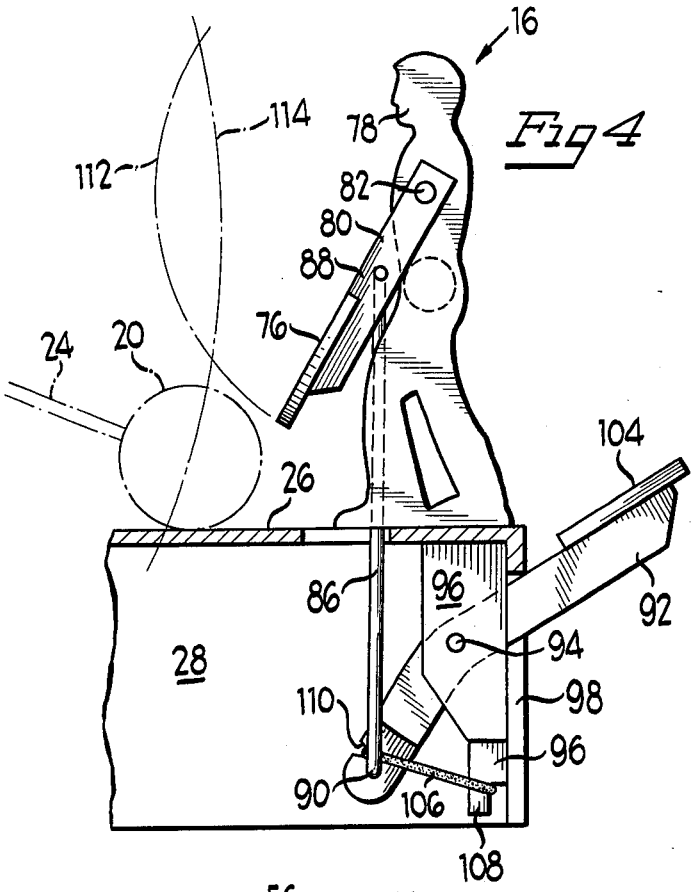
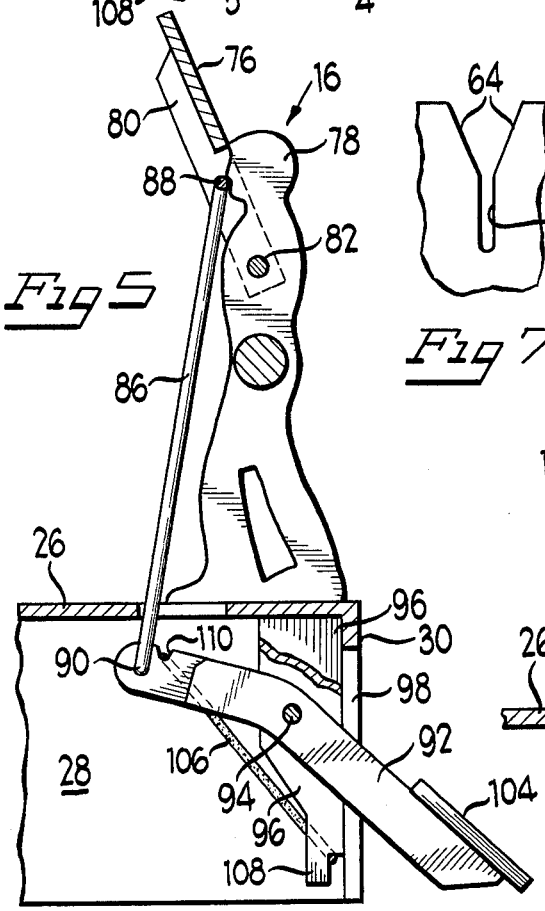
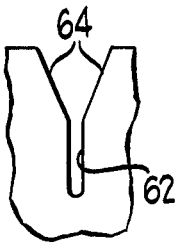
Fig 7
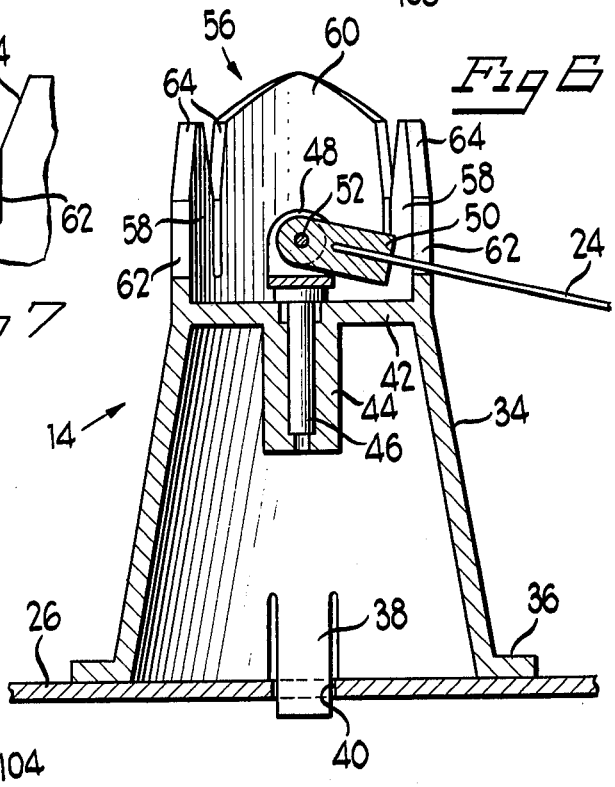

SIMULATED VOLLEYBALL GAME APPARATUS

BACKGROUND OF THE INVENTION

1. Field of the Invention

The present invention is directed to a game apparatus and particularly to a type for simulating the game of volley ball.

2. Brief Description of the Prior Art

The provision of game devices which simulate various types of sports have been well received by the public. One reason for their general acceptance is that most of these games utilize the same, or at least very close rules of play which enable various players to compete with the game device without having to learn a completely new set of rules for the play of the game. Often, the rules can be conveyed simply by designating the game by name, i.e., baseball, football, etc.

SUMMARY OF THE INVENTION

An object of the present invention is to provide a new and useful game apparatus which simulates the known game of volley ball.

The game apparatus embodying the concepts of the present invention includes a base structure having centrally disposed upright standard which is connected to a net. The net divides the base structure into two opposed playing areas for opposing players of the game. A ball is connected to the top of the standard by a tethering means providing universal movement for the ball. Three ball impellers are disposed on either side of the net, and are spaced from the central standard generally the length of the tethering arm. Each of the ball impellers includes a manually actuatable lever which operates a paddle for striking the ball to cause it to fly through the air to one of the other ball impellers, either on the same side or on opposite sides of the net. A plurality of detents are provided on the top of the standard for engagement with the tethering means to direct the ball toward one of the ball impellers. The actuation of the impellers must be timed with the flight of the ball in order to be able to strike the ball during flight.

Other objects, features and advantages of the invention will be apparent from the following detailed description taken in connection with the accompanying drawings.

BRIEF DESCRIPTION OF THE DRAWINGS

FIG. 3 is a fragmented vertical section through the game apparatus taken generally along the line 3—3 of FIG. 2 showing a front elevational view of one of the ball impellers;

FIG. 4 is a fragmented vertical section taken generally along the line 4—4 of FIG. 3;

FIG. 5 is a fragmented vertical section, taken generally along the line 5—5 of FIG. 3;

FIG. 6 is a fragmented vertical section of the standard, taken generally along the line 6—6 of FIG. 2; and FIG. 7 is a fragmented side elevational view of one of the detents provided in the top of the standard.

DESCRIPTION OF THE PREFERRED EMBODIMENT

Figure 1:
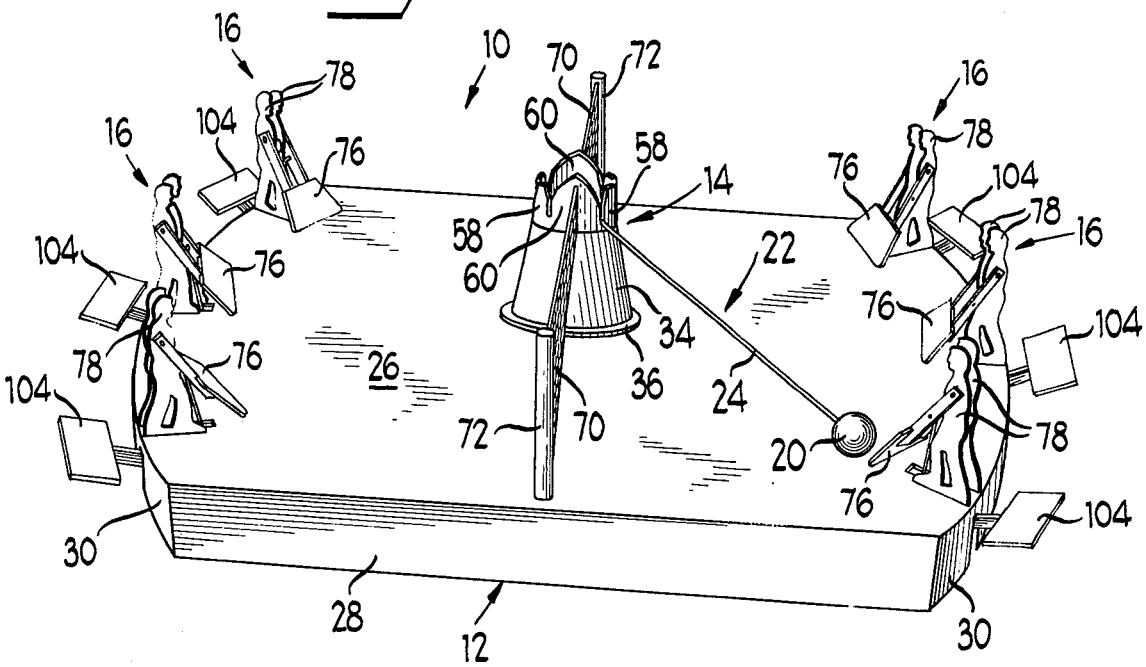
FIG. 1 is a perspective view of the game apparatus embodying the concepts of the present invention.

The game apparatus, generally designated 10 (FIG. 1), includes a base structure, generally designated 12, a centrally disposed standard 14 on the base and a plurality of ball impelling means, generally designated 16, positioned about the periphery of the base 12.

A game object 20 in the form of a ball is secured by a tethering means, generally designated 22, to the top of the standard. The tethering means comprises a rigid tethering arm 24 which is connected at its free end to the ball and at its other end to the top of the standard 14 by a universal mount.

The base structure 12 includes a flat playing area 26 and a pair of flat side walls 28 and arcuate end walls 30 dependingtherefrom which support the surface 26 on a suitable table or the like.

Referring to FIG. 6, the standard 14 includes an upstanding conical portion 34 which is supported on the surface 26 by an annular ring 36 provided on its bottom end. A pair of snap tabs 38 are inserted through slots 40 on the base to hold the standard in position. The top of the conical section 34 is closed by a disc 42 which supports a journal bearing 44. A journal or shaft 46 within the bearing 44 provides a universal mount for the tethering means 22. More particularly, a yoke 48 is secured to the journal 46 for rotation about a generally vertical axis. A T-connector 50 is pivotally mounted in the yoke 48 by a pin 52 extending therethrough. The tethering arm 24 is securely fastened to the leg of the T-connector 50. This assembly permits the tethering arm to rotate through any vertical angle in addition to rotation through any horizontal angle.

Figure 2:
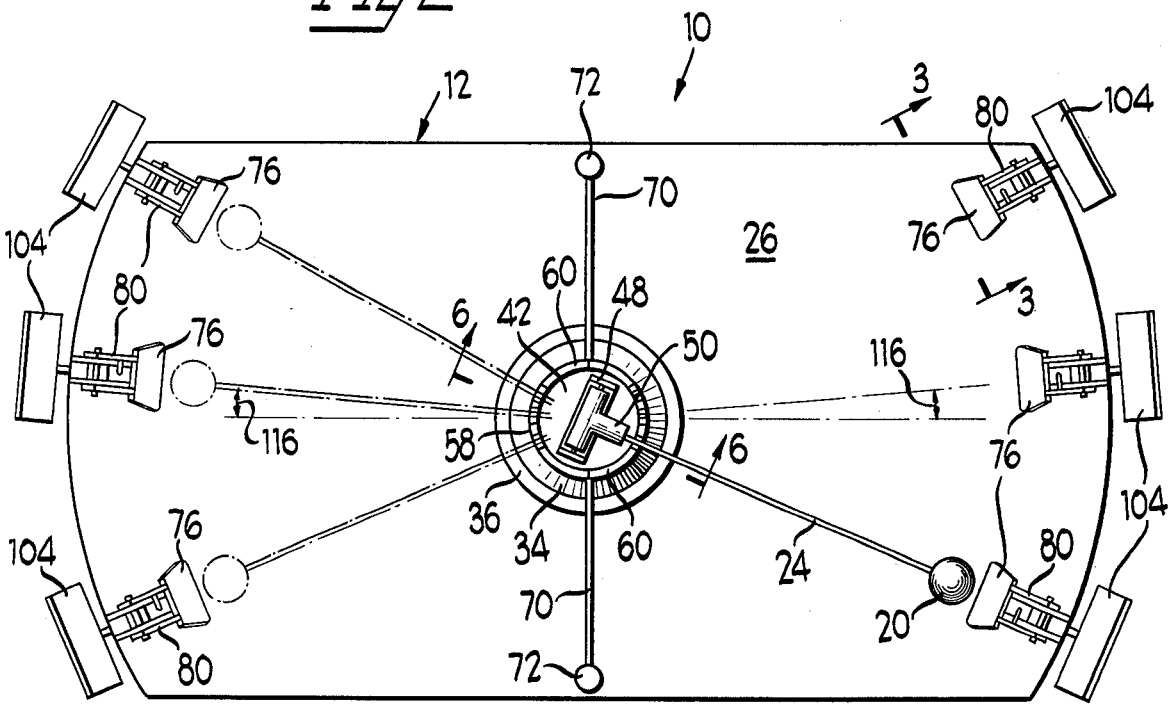
FIG. 2 is a top plan view of the game apparatus of FIG. 1.

A plurality of detent means, generally designated 56, are provided on the uppermost end of the standard, above the disc 42, for engaging and guiding the tethering arm 24. More particularly, a plurality of upstanding, generally pointed flanges 58 and slightly larger side flanges 60 define the detent means 56. FIG. 7 shows a side elevational view of the detent means defined by the flanges 58 and 60. Particularly, the detent means includes a vertical slot 62 between the flanges which widens at its uppermost end to provide guiding surfaces 64 defined by the tapered upper ends of the flanges 58 and 60. The standard thus provided with the above described detent means 56 will assure that the tethering arm 24, and thus the ball 20, will be directed into a position so that the ball can be engaged by one of the impelling means 16. FIG. 2 shows the tethering means in alignment with one of the detent means 56 and three possible positions shown in phantom on the opposite side of the standard 14.

A net 70 is provided to define two separate playing surfaces or areas for the respective players of the game. The net 70 is supported at its opposite ends by a pair of upstanding posts 72 on the playing surface 26 with its inward ends connected directly to the wall 34 of the standard 14.

The ball impellers 16 are provided to contact the ball 20 and cause it to pivot upwardly through the air either between the impellers 16 on the same side of the net or on the opposite side of the net. Referring to FIGS. 3, 4 and 5, each of the ball impellers 16 includes a paddle or ball engaging portion 76 which is pivotally supported on a pair of generally flat, upstanding human form figures 78. A pair of support levers 80 are connected to the paddles 76 and are pivotally mounted by a pin 82 generally through the shoulder area of the figures 78. A push rod 86 is connected by an L-shaped upper end 88 to one of the connecting levers 80 for actuation and movement of the paddle 76. The push rod 86 also is pivotally connected at its lowermost end by a second L-shaped portion 90 to a manually actuatable lever 92. The manually actuatable lever 92 is pivotally mounted by a pin 94 in a pair of flanges 96 directed inwardly from the arcuate walls 30 beneath each of the pairs of figures 78. The levers 92 extend through vertical slots 98 in the arcuate side walls 30 and include an offset portion at its innermost end to provide proper alignment for the push rods 86. Each of the levers 92 includes a pad 104 mounted on its exposed end for engagement by the fingers of the user. Resilient means in the form of a rubberband 106 serves to return the paddle 76 to its beginning position after the pad 104 is released. The resilient means is connected between a depending tab 108 on one of the flanges 96 and a notch 110 provided on the inner offset end of the lever 92. Each time the pad 104 is sharply hit by the player, the ball contacting pad 76 pivots upwardly, and at a faster angular rate than the pad 104 due to the difference in distances from the fulcrum points.

Referring to FIG. 4, the game apparatus 10 is designed to require that the players of the game contact the ball 20 while it is in flight. To this end, the tethering arm 24 is of such a length so that, if the ball is missed, and falls onto the surface 26, it is out of reach of the paddle 76 of the respective ball impeller 16 (see FIG. 4). As in the rules of volley ball, if a miss of this type occurs, the player must manually lift the ball in order to serve it to continue the play of the game. It can be seen in FIG. 4, however, that the respective arcs 112 and 114 for the paddle 76 and the ball 20 intersect when an impeller 16 is timely actuated by a player of the game.

Furthermore, in order to prevent a ball from merely being directed back and forth between the central impellers 16 on either side of the net, these impellers are offset by approximately five degrees from the centerline as shown by the arrow 116 designating this angular offset. In this manner, the game will be more interesting to the players. Additionally, three impellers 16 are provided on either side of the net to add more excitement and skill to the game. Since each player can only use two hands to operate the impellers, one of the impellers will be a prime target for the other player of the game since, a rapid flying ball toward a vacant impeller will possibly be missed by an opponent. Because of the universal connection of the tethering arm 24 to the standard 14, it also is possible for a player, who has acquired some skill in practice at the game, to transfer the ball 20 between his own players as is commonly done in the game of volley ball. This enables a player to attempt to transfer the ball so that it can be directed to a desired, directly opposing, impeller of the opponent.

The foregoing detailed description has been given for clearness of understanding only and no unnecessary limitations should be understood therefrom as some modifications will be obvious to those skilled in the art.

We claim:

1. A simulated volley ball game apparatus, comprising:

a base structure;

a generally centrally disposed standard on the base structure;

a ball connected to the top of the standard by an elongated rigid tethering means, said tethering means providing a universal connection so that the ball may pivot about the top of the standard in any direction;

a plurality of manually actuatable ball impelling means positioned on the base radially about the standard, said ball impelling means including a pivotally mounted paddle and manually actuatable linkage means connected to the paddle to permit timed actuation thereof to cause the paddle to contact the ball in an attempt to direct it generally toward another of said plurality of ball impelling means, said ball impelling means further being located at a predetermined distance from said standard so that the arc of travel of the ball intersects the arc of travel of the end of the paddle so that once the ball passes the path of travel of the paddle it cannot be impelled across the standard without manual intervention; and detent means on the standard about the universal connection for engagement with the rigid tethering means and for limiting and directing the travel of the ball positively toward one of the impelling means.

2. The game apparatus of claim 1 including a simulated net connected to the standard and directed radially outward therefrom to divide the base structure generally into two playing areas associated with respective players of the game.

3. The game apparatus of claim 1 wherein the paddles of each impelling means are pivotally mounted by a pair of two dimensional humanistic figures secured to the base structure.

4. The game apparatus of claim 1 wherein each detent means comprises a substantially vertical slot having a diverging upper end for guiding the tethering means into each of the vertical slots.

5. The game apparatus of claim 4 wherein said tethering means comprises a rigid arm connected to the top of the standard by a universal joint.

6. The game apparatus of claim 1 including at least three of said ball impelling means on either side of said standard.

7. A simulated volley ball game apparatus, comprising:

a base structure;

a generally, centrally disposed standard on the base structure;

a ball connected to the top of the standard by a rigid elongated tethering means, said rigid tethering means being mounted to the standard by a universal connection so that the ball may pivot about the top of the standard in any direction;

at least two manually actuatable ball impelling means positioned on the base on either side of said standard at a predetermined distance from the standard so that the arc of travel of the ball intersects a timely actuated ball impeller to cause the ball to be pivoted about its universal connection; and a plurality of detent means on the standard for engagement with the rigid tethering means for limiting and positively directing the ball only toward one of said ball impelling means.

8. The game apparatus of claim 7 wherein each of the ball impelling means includes a pivotally mounted paddle and manually actuatable linkage means connected to the paddle to permit timed actuation thereof to cause the paddle to contact the ball in an attempt to direct it generally toward another of said ball impelling means.

9. The game apparatus of claim 7 including a simulated net extending away from the standard on two sides thereof to define a playing area on either side of the base structure.

10. A simulated volley ball game apparatus, comprising:

a base structure;

a generally, centrally disposed standard on the base structure;

a ball connected to the top of the standard by a rigid elongated tethering means, said rigid tethering means being mounted to the standard by a universal connection so that the ball may pivot about the top of the standard in any direction;

a plurality of manually actuatable ball impelling means positioned on the base radially about the standard so as to enable contacting of the ball by timed actuation of the ball impellers to cause the ball to be pivoted about its universal connection across the standard; and a plurality of detent means on the standard for engagement with the rigid tethering means for limiting and positively directing the ball only toward one of said ball impelling means.

* * * * *